US005130706A

United States Patent [19]

Van Steenwyk

[11] Patent Number: 5,130,706

[45] Date of Patent: Jul. 14, 1992

[54] DIRECT SWITCHING MODULATION FOR ELECTROMAGNETIC BOREHOLE TELEMETRY

[75] Inventor: Donald H. Van Steenwyk, San Marino, Calif.

[73] Assignee: Scientific Drilling International, Houston, Tex.

[21] Appl. No.: 688,684

[22] Filed: Apr. 22, 1991

[51] Int. Cl.[5] ..... G01V 1/00

[52] U.S. Cl. ..... 340/854.6; 175/40; 166/250; 340/855.8

[58] Field of Search ..... 340/854, 855, 856; 175/40; 166/250

[56] References Cited

U.S. PATENT DOCUMENTS

| | | | |
|---|---|---|---|
| 2,354,887 | 8/1944 | Silverman et al. | 177/352 |
| 2,389,241 | 11/1945 | Silverman | 177/352 |
| 2,400,170 | 5/1946 | Silverman | 340/856 |
| 2,411,696 | 11/1946 | Silverman et al. | 177/352 |
| 2,492,794 | 12/1949 | Goble et al. | 250/2 |
| 3,079,549 | 2/1963 | Martin | 324/1 |
| 3,115,774 | 12/1963 | Kolb | 73/151 |
| 3,408,561 | 10/1968 | Redwine et al. | 324/6 |
| 3,793,632 | 2/1974 | Still | 340/853 |
| 3,967,201 | 6/1976 | Rorden | 179/82 |
| 4,057,781 | 11/1977 | Scherbatskoy | 340/853 |
| 4,348,672 | 9/1982 | Givler | 340/854 |
| 4,468,665 | 8/1984 | Thawley et al. | 340/856 |
| 4,689,620 | 7/1987 | Wondrak | 340/856 |
| 4,691,203 | 9/1987 | Rubin et al. | 340/856 |
| 4,739,325 | 4/1988 | MacLeod | 340/854 |
| 4,818,014 | 1/1980 | Zuvela et al. | 73/151 |

*Primary Examiner*—J. W. Eldred
*Attorney, Agent, or Firm*—William W. Haefliger

[57] ABSTRACT

An apparatus for borehole electromagnetic telemetry is provided comprising a direct switching element to couple energy from a downhole energy source to the earth-drillstring system, a downhole energy source that may be adapted to a variety of voltage levels, a system to control the switching element in response to the desired information to be telemetered, a system to adapt the voltage level of the downhole energy source to the desired level for the conditions of usage, and an insulated joint so that the energy to be transmitted can be injected into the earth-drillstring system.

29 Claims, 7 Drawing Sheets 18
30
118
18a
SENSING MEANS TO GENERATE DATA TO BE TRANSMITTED
40
33
SWITCHING ELEMENT CONTROL
12
36
35
118a
44
38
39
DIRECT SWITCHING ELEMENT
41
31
ENERGY SOURCE
VOLTAGE LEVEL ADAPTER
43
32
34
37
42
15

33
44
38
39
12
36
31
35
43
15
42
37

FIG. 3.
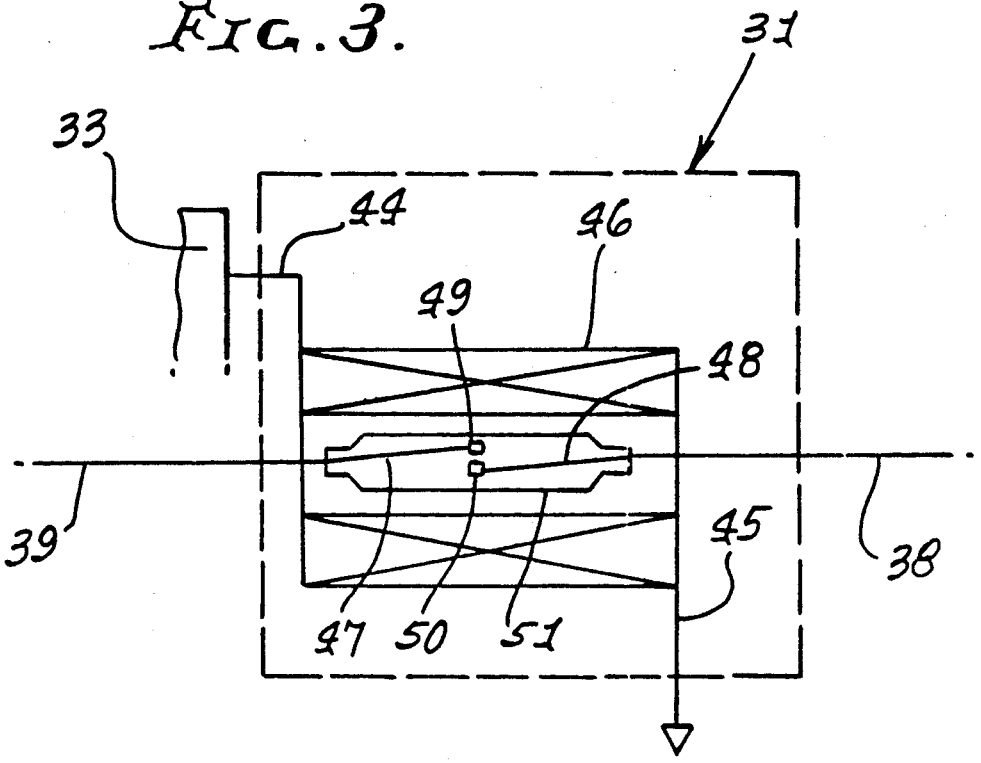
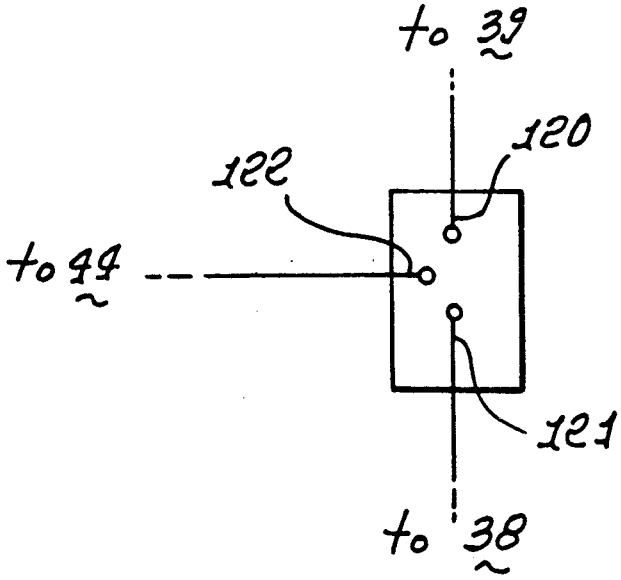
FIG. 3a.

62
65
66
60
63
64
61
137
TO 39
140
142
143
141
142
BIT

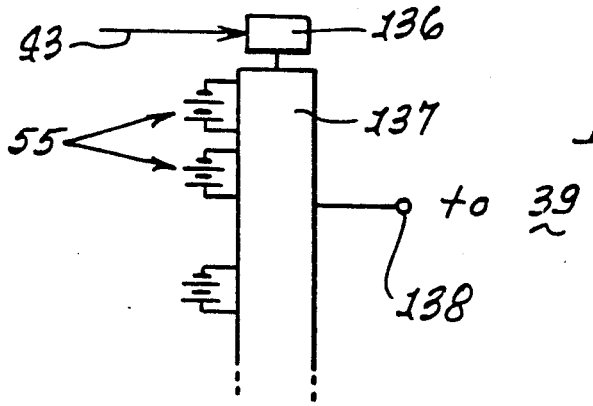
FIG. 4c.
FIG. 5.
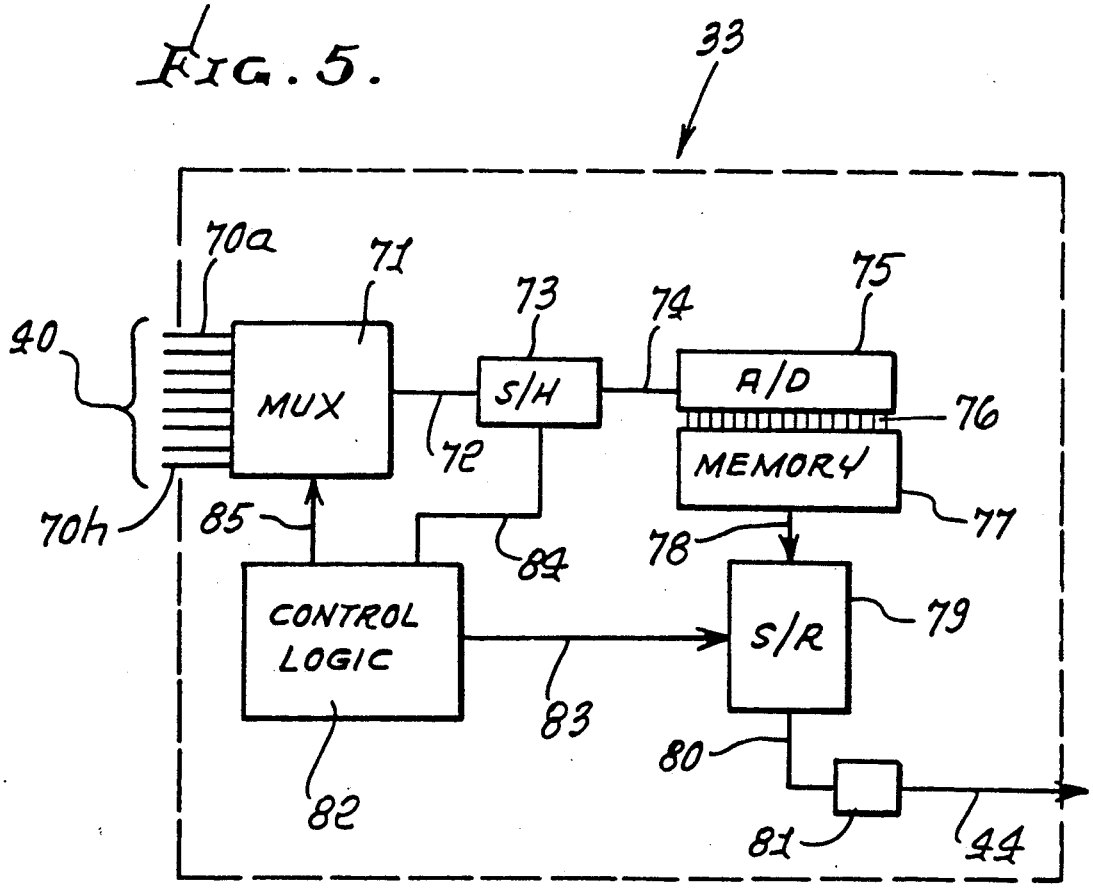

DIRECT SWITCHING MODULATION FOR ELECTROMAGNETIC BOREHOLE TELEMETRY

BACKGROUND OF THE INVENTION

This invention relates generally to electromagnetic borehole telemetry, and more particularly to efficient and controllable coupling of energy from a downhole energy source to an earth-drillstring system.

In electromagnetic borehole telemetry, it is known to couple electromagnetic energy to the earth-drillstring system by means such as toroidal coupling transformers, ferrite rod antennae, impedance matching switching amplifiers, and other similar devices, in order to provide an optimum matching of the energy source impedance to the earth-drillstring load impedance. The significant technical problem in electromagnetic transmission through and/or along the earth-drillstring system is the high attenuation of signal due to the generally high conductivity of the earth portion of the transmission path. Several approaches have included provision of repeater amplification means along the transmission path, to offset the severe attenuation problem.

Systems proposed for such intended usages include those disclosed in U.S. Pat. Nos. 2,354,887; 2,389,241; 2,411,696; 2,492,794; 3,079,549; 3,115,774; 3,048,561; 3,793,632; 3,967,201; 4,057,781; 4,181,014; 4,348,672; and 4,691,203.

The large number of patents and extensive published literature on the subject attest to the large amount of work done in this field and the difficulties of achieving the desired results. Despite the extensive work shown by the prior art, there has been very little commercial success obtained. One significant explanation is that too much was expected from each chosen approach, and that when the limitations of the physical problem prevented full realization of the goals, the effort was dropped in favor of other approaches. Also, it is believed that the complexities of certain approaches, when reduced to practice, resulted in poor equipment reliability in downhole drilling environments, excessively high initial equipment cost, and excessively high operation costs.

SUMMARY OF THE INVENTION

A major objective of the present invention is to provide a simple, low cost, highly reliable electromagnetic telemetry system for use in boreholes. In contrast to prior art, the emphasis is on simplicity to achieve the desired cost and reliability advantages, rather than the achievement of all of the desired transmission bandwidth under the worst case transmission conditions. The invention provides a simple, straightforward apparatus and method to be employed in those drilling situations wherein a suitable signal to noise ratio can be achieved.

The electromagnetic borehole telemetry apparatus of the present invention comprises the combination of a direct switching element to couple energy from a downhole energy source to the earth-drillstring system, a downhole energy source that may be adapted to a variety of voltage levels, a means to control the switching element in response to the desired information to be telemetered, a means to adapt the voltage level of the downhole energy source to the level best suited for the conditions of usage, and an insulated joint means achieving injection into the earth-drillstring system of energy to be transmitted.

As will appear, the direct switching element may comprise a semiconductor switch or a mechanical switch. In a preferred embodiment of the invention, the direct switching element is a "magnetic reed switch" similar to a type manufactured by Hamlin, Inc., 612 East Lake Street, Lake Mills, Wis. Such a reed switch can be operated mechanically by moving a magnetic element near it, or magnetically by means of a solenoidal coil wound around it. It has very low contact resistance when closed, very high open circuit resistance when open, excellent operation at very high temperatures, excellent resistance to severe shock and vibration, and extremely low cost for such outstanding switch properties.

The downhole energy source typically comprises a multi-cell battery, configured so that the cells may be controllably connected in various series-parallel combinations to achieve a net voltage level from as low as that of one cell to as high as that of all cells in series. Alternatively, the energy source may comprise a battery or other source of electrical power, together with a DC to AC converter means and a transformer/rectifier means that may, by means of different tap connections on the transformer, provide a range of output voltages.

The means to control the switching element in response to information to be telemetered may comprise a simple voltage level supply or source to control a semiconductor switch, or a mechanical or magnetic solenoid means to control a magnetic reed switch of the preferred type. The control means may be used, for example, to control the time duration, wave shape, or frequency of the output energy to be transmitted.

The means to adapt the voltage level of the downhole energy source to a level best suited for conditions of usage may comprise means for controllably connecting or reconnecting a multi-cell battery to achieve the desired voltage, or means for controllably connecting or reconnecting taps on a transformer, to change the output voltage of a transformer/rectifier. These were referred to above in connection with the energy source. The means to effect such connection or reconnection may include manual connection or reconnection means operable at the well surface before the telemetry system is introduced into the borehole. Such means suffices if the downhole impedance conditions can be adequately predicted, based on known or assumed, or experimentally determined geological structure. Alternatively, reconnection of the energy source control elements may be accomplished automatically downhole in response to some measured parameter or some control signal. One such contemplated means allows adaptation of the energy source based on the measured output power transmitted into the earth-drillstring system. Thus if the load impedance represented by the earth-drillstring system increases, for any reason, the voltage level may be automatically increased until the original power level is again transmitted. Alternatively, signals can be transmitted from the surface to the downhole telemetry system, by any of a number of means, that will command the adaptation of the downhole energy source voltage to achieve a usable signal level at the surface with the lowest possible transmitted power. Such means assures the longest possible operation of battery (or other energy storage) powered downhole equipment.

The insulated joint means referred to provides both electrical insulation and the necessary mechanical strength. The joint design may be either axial or radial, as will appear.

These and other objects and advantages of the invention, as well as the details of an illustrative embodiment, will be more fully understood from the following specification and drawings, in which:

DRAWING DESCRIPTION

Figure 2:
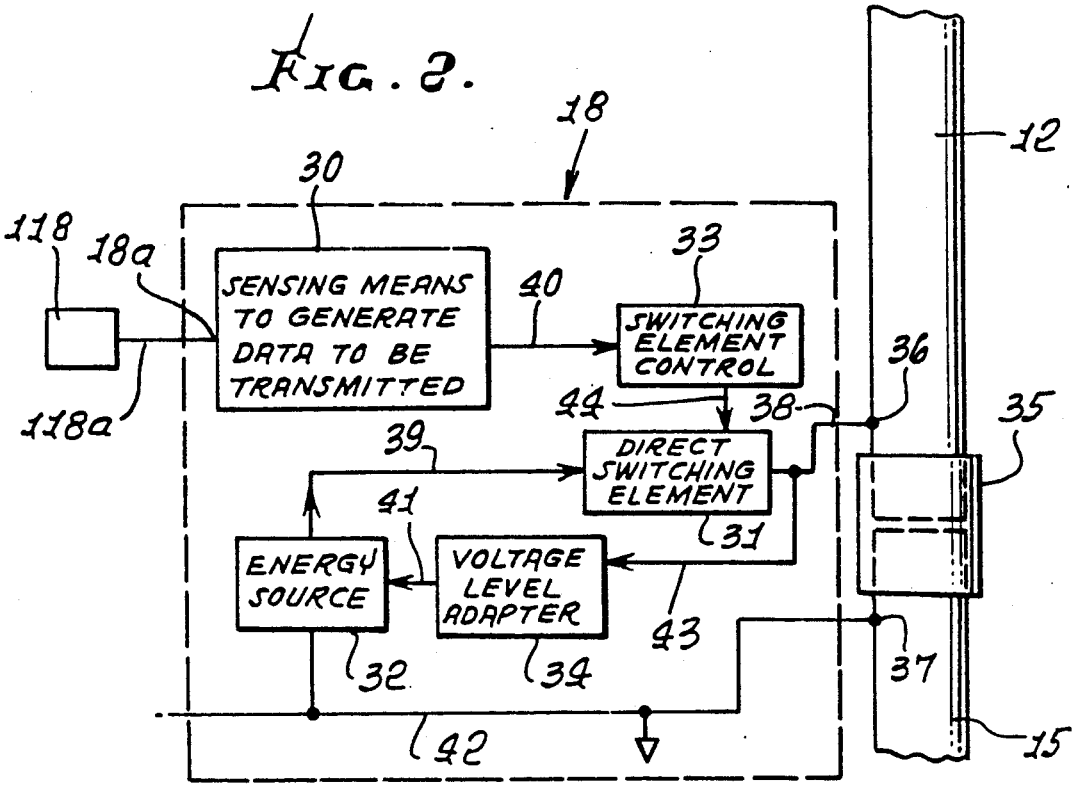
FIG. 2 is a block diagram showing the principal elements of the electromagnetic borehole telemetry apparatus and their relationships.
Figure 2A:
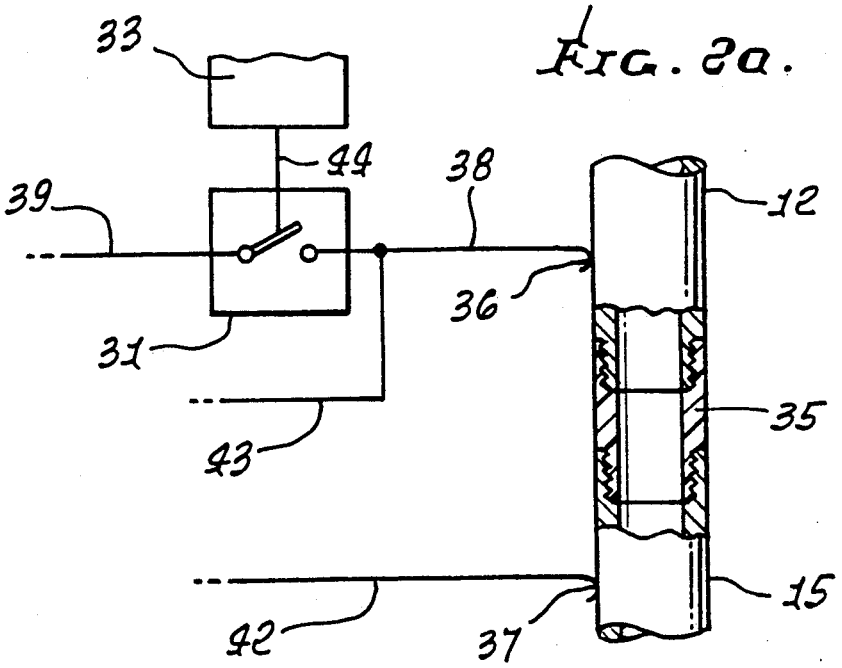
Figure 4A:
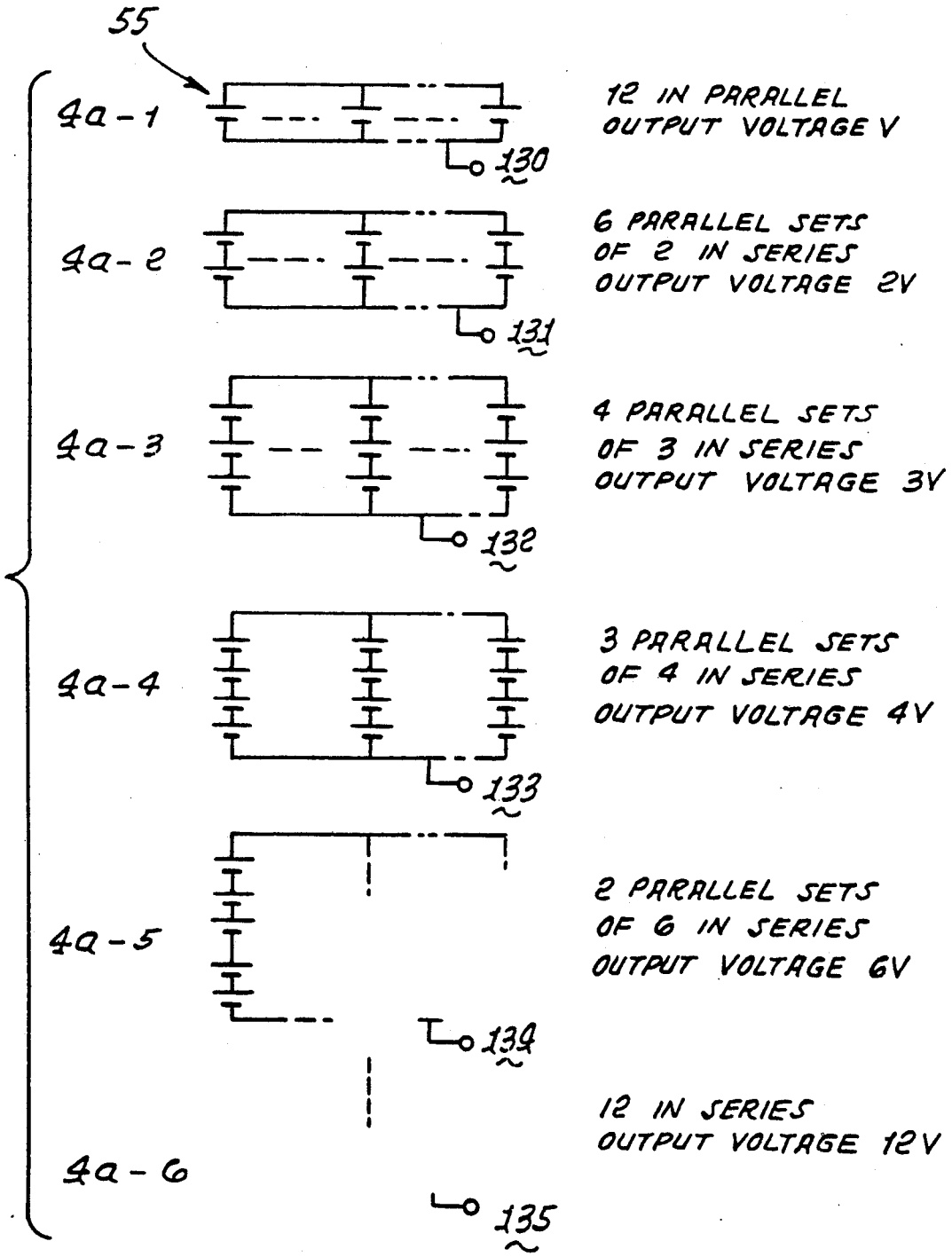
Figure 4B:
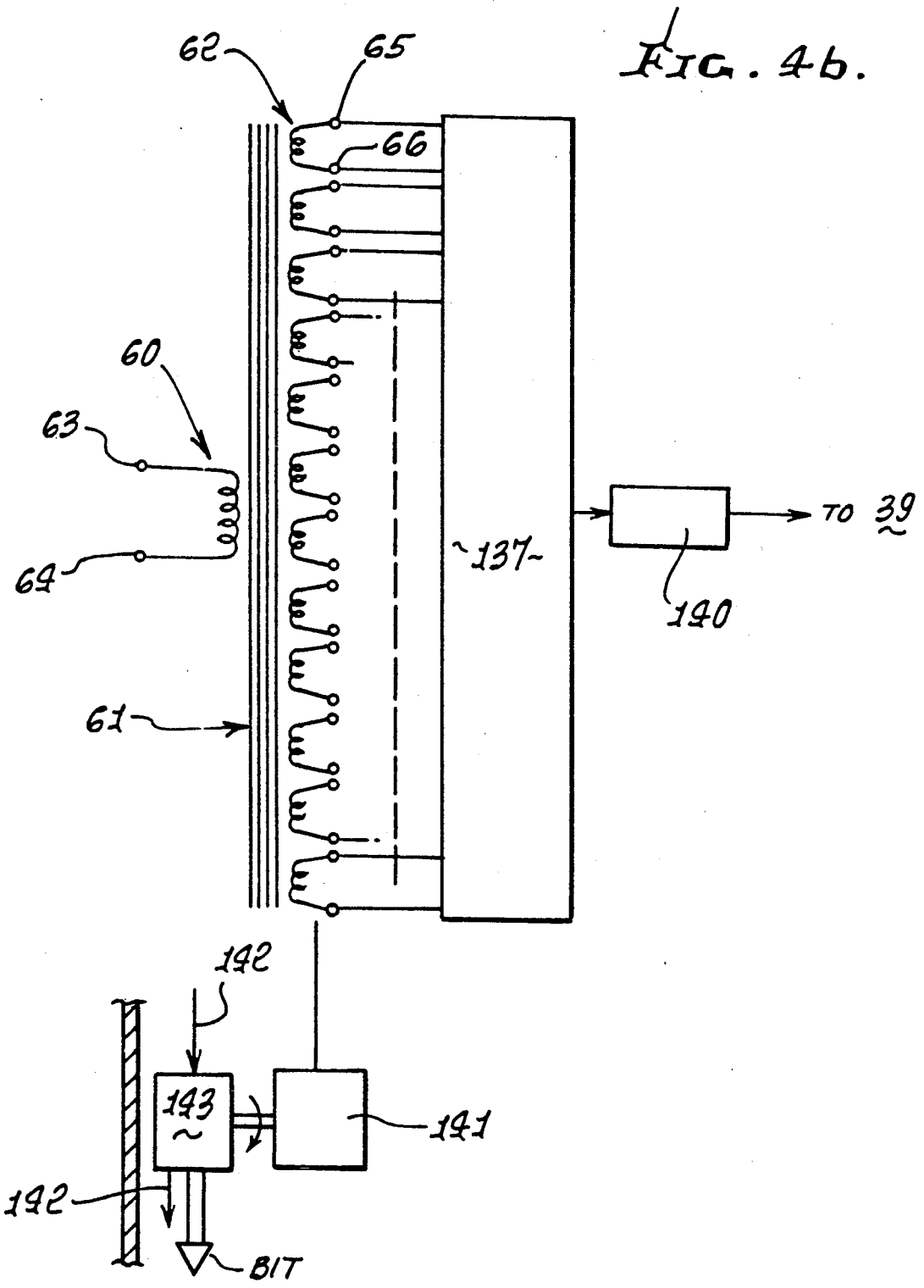
Figure 6:
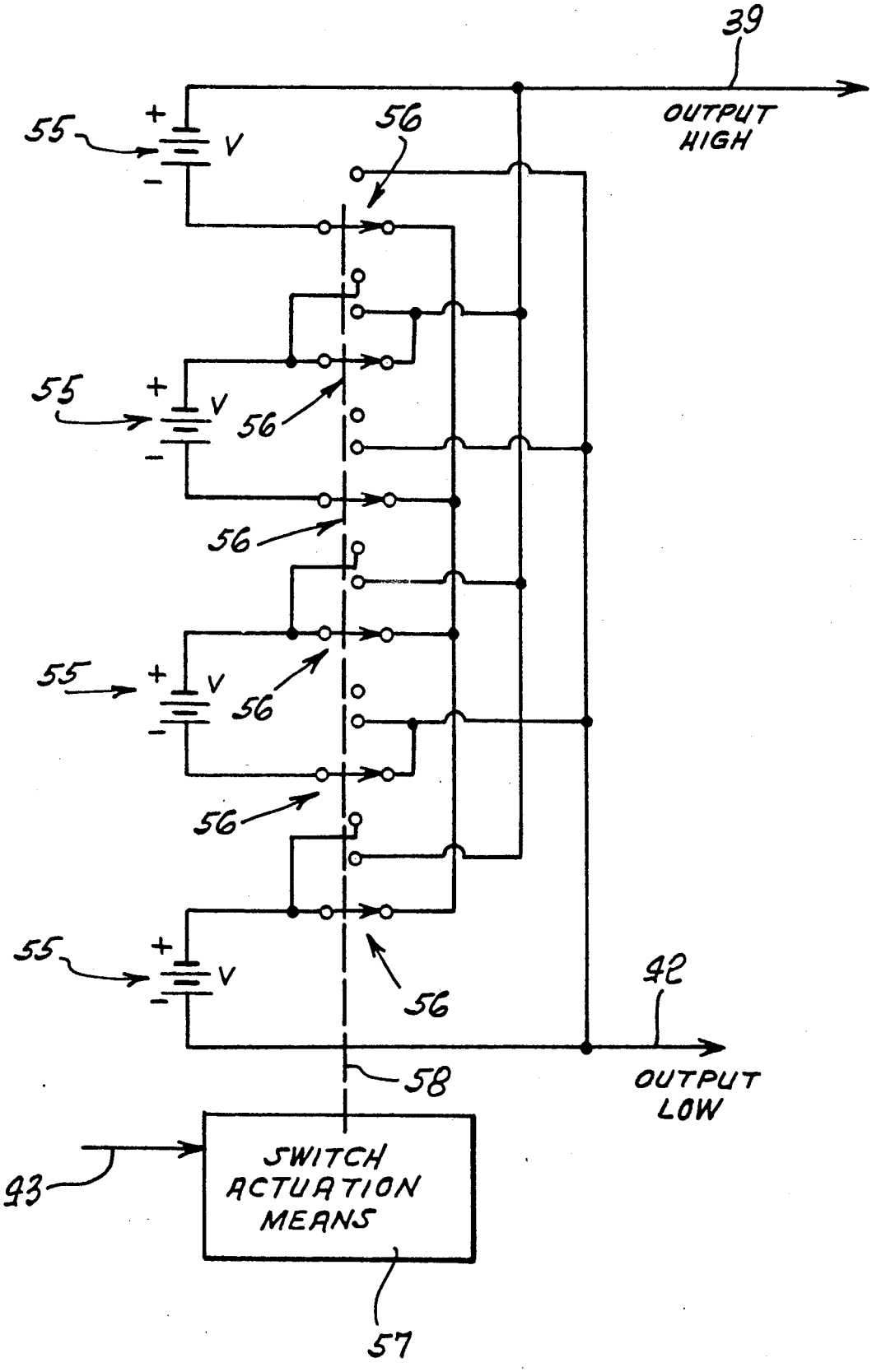

FIG. 2*a* is a section showing an insulated joint;

FIG. 3 is a section showing a typical "magnetic reed switch";

FIG. 3*a* is a representation of a control transistor;

FIGS. 4*a* and 4*b* are circuit diagrams that show alternative configurations for downhole energy sources; and FIG. 4*c* shows a cell switch control;

FIG. 5 is a block diagram of circuit means to control the switching element; and FIG. 6 is a circuit schematic showing one form of means to control or adapt the voltage level of the downhole energy source.

DETAILED DESCRIPTION

Figure 1:
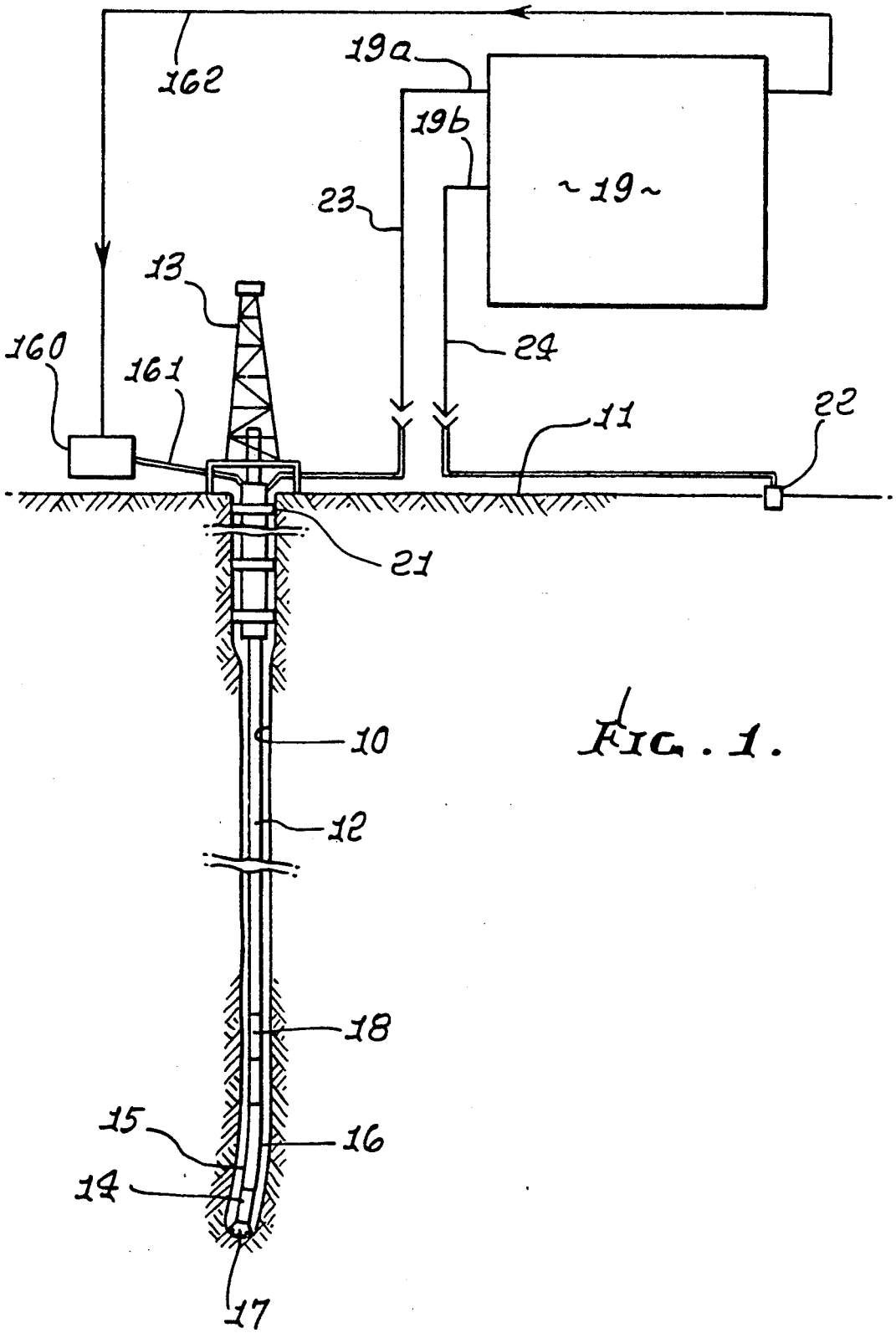
FIG. 1 is an elevation illustrating in schematic form a drilling rig, a borehole, and a downhole telemetry apparatus showing the overall use of the invention.

With reference first to FIG. 1, there is represented at 10 a well bore extending downwardly into the earth formation from the surface of the earth, represented at 11. A tubular drill string 12 (typically of steel) extends downwardly from the drilling rig 13, and is formed of a number of threadedly interconnected pipe sections carrying at their lower end a directional drilling unit 14. This unit includes a "bent sub" 15 taking the form of a tubular pipe having a slight bend at 16 causing the hole drilled by unit 14 to advance laterally in a predetermined direction as it advances downwardly. At its lower end, the bent sub 15 carries a bit 17 which is driven rotatively relative to the sub by a motor contained in the sub and driving the bit to drill the hole as the drill string advances longitudinally. The motor may be driven by any convenient source of power, as for example by the pressure of drilling fluid which is forced downwardly through the interior of drill string 12 and then discharges past the bit and upwardly about the outside of the drill string to the surface of the earth.

At a location above the drilling unit 14, the string 12 contains an instrument assembly 18 constructed in accordance with the invention for sensing the direction or azimuth to which the bent sub 15 is turned in the hole, and then transmitting that information upwardly to a signal receiving or readout unit 19 at the surface of the earth. The signals are transmitted by unit 18 as electrical currents through the drill string and through surrounding earth conductivity. These currents are sensed as a difference in potential between two electrodes, one 21 contacting the drill string near the earth surface and the other 22 contacting the earth at a distance from the drill string. Electrode 21 is connected by an insulated conductor 23 to input 19*a* at a first side of the signal receiving and potential difference sensing unit 19. The second electrode 22 contacts the earth at a substantial distance from the drill rig 13 and is connected to input 19*b* at a second side of the signal receiving unit 19 by insulated wire 24. The electrode 22 may be formed of any highly conductive metal, such as copper, having a substantial area in contact with the earth's surface. It may take the form of a plate, a rod implanted to any depth in the earth or a conductor wire completely surrounding the drill rig 13 at a substantial distance.

As seen in FIG. 2, the instrument assembly or unit 18 contains sensing means 30 to generate the data to be transmitted to the surface. Such means 30 may include, for example, accelerometers to determine the spacial orientation of the unit 18 with respect to the earth's gravity field, magnetometers to determine the orientation of the unit with respect to the earth's magnetic field, temperature sensors, pressure sensors, or any other kind of sensor which may provide useful information about the conditions in or at the bottom of the well bore. Instrument assembly 18 also contains circuitry including an energy source 32, a direct switching element 31, a switching element control 33, and a voltage level adapter 34. The output of assembly 18 is an electrical current provided at wires 38 and 42 that are connected to the metallic (steel) drill string by contacts as shown at 36 and 37 respectively. Electrical isolation between points 36 and 37 is provided by the electrically insulated joint 35 in the pipestring, for example a KEVLAR sub, as seen in FIG. 2*a*.

In operation the instrument assembly 18 functions so that the sensed data provided by sensing means 30 is provided as an output on lead 40, as an input to the switching control means 33. The latter reacts to the signal arriving on lead 40 and provides an output on lead or mechanical connection 44 that controls the state of the direct switching element 31. The control is such that the state of the switching element 31 is either open, (a very high resistance state), or closed, (a very low resistance state). In its closed state the direct switching element 31 connects the output of the electrical energy source 32 to the output wire 38, thus allowing electrical current to flow from the energy source 32 into the drill string 12 at upper contact 36. Source 32 is connected to 31, as via lead 39. When the direct switching element 31 is in its open state, current is blocked from flowing from the energy source 32 into the drill string.

The output current, and associated voltage, in lead 38 are sensed at lead 43 and supplied to the voltage level adapter 34. The sensing means 30 may be of any desired type as indicated above. Merely as illustrative, it may for example sense components of the Earth's gravity and magnetic fields as in U.S. Pat. No. 3,862,499 incorporated herein by reference. The remainder of the apparatus and its means of operation to transmit the output of the sensing means to the surface will be better understood by the detail descriptions of the elements of the instrument assembly 18 provided below.

One embodiment of the direct switching element 31 is shown in FIG. 3. The input lead 39, coming (as shown in FIG. 2) from the energy source 32 is connected to movable reed 47 having at its tip a contact 49. The output lead 38, connected as shown in FIG. 2 to the drill string 12 at contact 36, is similarly connected to a movable reed 48 having at its tip a contact 50. The two reeds 47 and 48 are made of magnetic materials and are sealed, in an inert atmosphere, in a glass envelope 51. Whenever a magnetic field is caused to exist along the generally elongated axis of the reeds, they tend to become aligned more strongly with the direction of the magnetic field and the two contacts 49 and 50 touch each other to make a continuous low resistance path from lead 39 to lead 38. When the magnetic field is removed from the reed region as referred to, the slight spring action of the reeds causes the contacts to separate, thus establishing a high resistance path from the input lead to the output lead.

Around the glass envelope 51 is a solenoid coil 46 consisting of multiple turns of wire. The wire 45 at one end of the coil is shown connected to an electrical ground or common connection. The wire 44 at the other end of the coil is shown connected to the switching element control 33. As is well known, a current entering the coil by wire 44 and exiting the coil at wire 45 will create a magnetic field extending along the axis of the coil at is interior region. This filed then provides the field referred to above causing the contacts 49 and 50 to touch and provide a low resistance path from lead 39 to lead 38. The switching control element 33 may provide a selected or pre-determined pattern of current on lead 44 to achieve the same pattern of current flowing from lead 39 to 38. Since the electrical current required to force contacts 49 and 50 together will in general be very small compared to the output current flowing from 39 to 38, a very efficient control of output current is provided by the direct switch element 31.

Alternatively, in place of the magnetically controlled magnetic reed switch shown in FIG. 3, a semiconductor switch can be used. A very low resistance is desired in the conduction path when the switch is closed and a very high resistance is desired when the switch is open. One particularly suitable semiconductor switch is of the MOSFET type, a IRFZ44 N-Channel transistor manufactured by International Rectifier Co., El Segundo, Calif. that provide a very low ON resistance of only 0.028 ohms. Such a MOFSET device had three terminals, the source, drain and gate. See elements 120, 121 and 122 in the transistor 123 seen in FIG. 3*a*. When a suitable voltage is applied to the gate terminal 122 the effective resistance between the source 120 and drain 121 is very low. When the voltage is removed from gate 122, a high resistance is seen between terminals 120 and 121. When such a semiconductor switch is used to replace the magnetic reed switch in FIG. 2 for example, the source terminal would be connected to lead 39, the drain terminal would be connected to lead 38, and the gate terminal would be connected to lead 44 coming from the switching control element 33. In this case the lead 44 would be driven to a suitable voltage when it was desired to force the direct switching element into its low resistance state. The pattern of current flowing from lead 39 to lead 38 would then similarly follow the voltage pattern applied at lead 44.

The energy source 32 may take a variety of forms. FIG. 4*a* shows one form in which a group of individual battery 55 cells may interconnect in a number of ways to provide the same total energy output at different output voltage levels. For example, the twelve individual cells shown may be connected all in parallel (see 4*a*-1) to provide an output voltage, V, that is equal to each individual cell voltage. Alternatively, the same twelve cells may be connected as six parallel connections of two-cell sets that are connected in series (see 4*a*-2). This provide the same total energy output capability, but at an output voltage of 2V. Similarly, the connections can be made as four parallel connections of three-cell series cells (see 4*a*-3); three parallel connections of four-cell series cells (see 4*a*-4); two parallel connections of six-cell series cells (see 4*a*-5); or lastly as twelve cells in series (see 4*a*-5). These combinations provide output voltages of 3V, 4V, 6V and 12V respectively. The various output points are indicated at 130 to 135. All have the same total output energy capability.

FIG. 4*c* shows a switch 137 connected to all cells, and operable to connect them in the configurations described. One output 138 is shown, instead of points 130–135. A switch control appears at 136. This adaptability in voltage level while retaining the full energy capability of the cells permits a high degree in optimization of the power output of the telemetry system.

If a high electrical resistance is found or seen at the driving point contact 36, then a high voltage may be used. On the other hand, if a low electrical resistance is found or seen at the driving point 36, then a low voltage may be used. See subsequent discussion of the use of adapter 34 for this purpose. In this way, the voltage of the energy source may be adapted to the resistance encountered to provide nearly constant power output, independent of the effective load resistance seen at the contact 36.

Alternatively, the energy source 32 may comprise a fixed battery of any configuration, a means to convert such battery power to alternating current, a transformer assembly as shown in FIG. 4*b* and a single output rectifier assembly. In FIG. 4*b*, the transformer primary 60 is shown as connected to terminals 63 and 64, the stated source of alternating current. The magnetic course 61 provides efficient coupled to the, for example twelve, individual secondary windings 62. Each of the twelve secondary winding is provided with terminals 65 and 66. It is easily seen that these twelve individual secondary windings can each be regarded as equivalent to the individual battery cells 55 in FIG. 4*a* or 4*c*, and that they may then be connected, or switched as at 137 just as the individual battery cells were, to provide an alternating current output ranging from V, the voltage of one secondary, to 12V, the voltage of all twelve connected in series. This output can then be rectified as at 140 to provide a direct current output on lead 39 having the same voltage range and therefore the same capability to match a variable load resistance as shown in FIG. 4*a*. Similarly, the individual secondary windings could be output windings on a drilling mud turbine driven alternator, rather than secondary windings on a transformer driven by alternating current provided by a battery and suitable electronics. See alternator 141 schematically shown in FIG. 4*b*, and mud flow indicated by arrows 142 driving turbine 143 driving the alternator.

The examples shown by FIGS. 4*a* and 4*b* can be extended to either greater or smaller numbers of individual sources. As shown, the available voltage range of twelve to one permits adapting to load resistance ranges of one hundred and forty four to one, since power output is equal to the square of the output voltage divided by the load resistance.

FIG. 5 shows one embodiment of the switching control element 33. The input lead 40, from the sensor assembly, may, as indicated, comprise a number of individual signal lines from each individual sensor. These individual signal lines, shown as 70*a* to 70*h*, are connected to the input of an electronic multiplexing circuit 71 that, under control of its input control signal at 85 will connect one of the inputs 70*a* to 70*h* to the output lead 72. The control at 85 will, in general, simply select the input leads in a continuing sequence so that all are sequentially connected to the output lead 72, such multiplying techniques being known (for example, a rotary lead successively engaging circularly spaced controls to which leads 70a–70h are connected). Lead 72 is in turn connected directly to a sample-and-hold circuit 73 that connects the input lead 72 to the output 74 and holds its voltage constant for the time required for the analog-to-digital converter 75 to sense the held analog voltage and provide a digital representation of the input voltage on lead 74 as a parallel digital output at 76 to a short time memory unit 77. The latter accumulates digital data representative of all of the sensor outputs and holds this data until a complete set has been gathered for transmission to the surface. When a complete message is ready for transmission to the surface, that message is transmitted serially from the memory unit 77 on lead 78 to an electronic shift register 79. When the complete message is stored in the shift register, the message is shifted out of the shift register 79 one bit at a time under control of a clock signal on the input line 83. As each bit of data is shifted out on line 80 it is amplified in power by amplifier 81 having its output connected to the switch 31 drive line 44.

Shown at 82 is the control logic assembly that controls the timing of the process, and producing clock signals at 83. In addition to the shift control signal shown at 83, discussed above, logic assembly 82 also provides control signals at lead 85 that select which item of sensor data is to be presented to the output lead 72 at any time and a control signal at 84 that controls the sample-and-hold circuit 73. Together, all of the elements shown within the switching control means or element 33 provide the selection of what data is to be transmitted, the timing for its transmission, and the actual format and timing of the output data stream.

As stated previously, the output voltage of the energy source 32 may be adapted to meet the desired power level into whatever load resistance is found at contact 36 on drill string 12. FIG. 2 showed a general approach as discussed previously in which a signal on lead 43 provides information about the output voltage and current, such signal flowing to the voltage level adapter 34 which provides an output at 41 to energy source 32. FIG. 6 shows one means to provide the combined functions of the voltage adapter and energy source, 34 and 32.

For simplicity in ease of understanding, the energy source and voltage level adapter is shown in FIG. 6 with only four individual battery cells and thus three output voltage levels of V, 2V, and 4V. Four individual battery cells 55 are shown together with six single-pole three-position switches 56. The six switches 56 are ganged together by shaft 58 that is driven, for example, by an electromechanical stepping motor contained as part of the switch actuation means 57. When switches 56 are in position 1 (see terminals "1"), it may be seen that all four of the individual battery cells 55 are directly in parallel and the output voltage between leads 39 and 42 is V, the individual voltage for each cell. When the switches 56 are in (terminal) positions 2, it may be seen in the figure that the top two battery cells are in parallel, the bottom two battery cells are in parallel, and the group of two parallel cells at the top is in series with the group of two parallel cells at the bottom. The output voltage level between lead 39 and 42 is therefore 2V. When the switches 56 are in (terminal) positions 3, it may be seen that all four individual battery cells are in series and the resultant output is 4V. In consideration of the realized output levels here from four individual cells and those shown in the discussion of FIG. 4a it may be seen that the number of combinations that realize the full total energy of the individual cells is found by finding the number of individual even divisors there are for the number of cells. For example, with twelve cells, the even individual divisors are 12, 6, 4, 3, 2 and 2. For only four cells they are 4, 2 and 1. If one had twenty four cells they would be 24, 12, 8, 6, 4, 3, 2 and 1. Recognizing this, the required number of cells to achieve a range of voltage control is readily determined.

The switch activation means 57 shown in FIG. 6 may, as previously stated, contain an electromechanical stepping motor to select the output position for the shaft 58 and thereby determined the output voltage between leads 39 and 42. The input lead 43, coming from the output of the direct switching element 31 as shown in FIG. 2 might, for example represent the voltage at the output line 38 and the current flowing in the line 38 to the contact 36 on the drill string 12. Within the switch activation means 57, electronic means is typically employed for multiplying the sensed voltage and the sensed current to provide the output power into the upper drill string from point 36. This computed power can then be compared to a pre-stored desired power output and circuitry can then operate the stepper motor to select the position of the output shaft that provides a power output most nearly the desired or selected level. Thus 57 represents multiplier and comparator circuitry.

Alternatively, the input signal shown at 43 in FIG. 6 can be derived from information transmitted downwardly from the surface. For example, electrical transmission or pressure modulation of the mud flow coming from the surface can be used to transmit a signal or signals to cause the output power at 36 to increase or decrease as desired. This permits the surface control to increase power when low received signal strength at 21 or 19 is encountered, and to decrease power, and consequently increase battery life, when more than adequate signal strengths are encountered at 21 or 19. FIG. 1 shows a mud pressure modulation means 160 connected in mud flow line 161, and control lead 162 from 19 to 160.

The insulated pipe joint shown at 35 in FIG. 2 may be of any suitable type and is not explicitly a part of this invention. All that is required is that the upper portion of the drill string 12 be electrically insulated from the lower portion of the bottom hole assembly 15, so that the output electrical current provided between terminals 36 and 37 will not be shorted out by the structure.

In the above, the control 33 may control the time duration of the energy or voltage transmission at 36, or the wave shape, or the frequency of such transmission.

I claim:

1. An apparatus for electromagnetic telemetry of information from a drillstring location in a borehole in the earth, to another location, the drillstring and the earth defining an earth-drillstring system comprising:

a) a direct switching element to coupled energy from a downhole source to the earth-drillstring system, b) an energy source, with internal connections, having selectively controllable output levels downhole allowing selective adaptation to different voltage levels of signal transmission, c) a means to control said switching element in correspondence to the desired information to be transmitted, d) control means operatively connected to said energy source to adjust the output voltage level of said downhole energy source to desired level for said telemetry, e) and coupling means for coupling said switching element to the earth-drillstring system, whereby energy may be transmitted from said switching element and injected directly into the earth-drillstring system, f) said control means including means to enable automatic changes to the internal connections of said energy source in response to commands received from the surface.

2. The apparatus of claim 1 wherein said direct switching element is a semiconductor switch.

3. The apparatus of claim 2 wherein the means to control said direct switching element provides a voltage level that will cause said semiconductor switch to change from a non-conducting to a conducting state.

4. The apparatus of claim 1 wherein said direct switching element is a magnetic reed switch.

5. The apparatus of claim 4 wherein the means to control said direct switching element is a mechanical means that moves a permanent magnet in relation to said magnetic reed switch so as to cause said switch to change from an open circuit to a closed circuit state.

6. The apparatus of claim 4 wherein the means to control said direct switching element is a magnetic solenoid around said magnetic reed switch so as to cause said switch to change from an open circuit to a closed circuit state when a current is applied to said solenoid.

7. The apparatus of claim 1 wherein said downhole energy source is a multi-cell battery, configured so that the multiple cells can be connected in configurations to achieve different desired voltage levels.

8. An apparatus for electromagnetic telemetry of information from a drillstring location in a borehole in the earth, to another location, the drill string and the earth defining an earth-drillstring system comprising:

a) a direct switching element to couple energy from a downhole source to the earth-drillstring system, b) an energy source having selectively controllable output levels downhole allowing selective adaptation to different voltage levels of signal transmission, c) a means to control said switching element in correspondence to the desired information to be transmitted, d) control means operatively connected to said energy source to adjust the output voltage level of said downhole energy source to desired level for said telemetry, e) and coupling means for coupling said switching element to the earth-drillstring system, whereby energy may be transmitted from said switching element and injected directly into the earth-drillstring system, f) said energy source comprising:

i) a source of electrical energy, ii) means to convert said electrical energy source to an alternating current source, iii) means including transformer and rectified elements to convert the alternating current source to a low voltage direct current output, iv) and means to control the turns ratio of said transformer to adjust said low voltage direct current output to achieve desired output voltage levels.

9. An apparatus for electromagnetic telemetry of information from a drillstring location in a borehole in the earth, to another location, the drill string and the earth defining an earth-drillstring system comprising:

a) a direct switching element to couple energy from a downhole source to the earth-drillstring system, b) an energy source having selectively controllable output levels downhole allowing selective adaptation to different voltage levels of signal transmission, c) a means to control said switching element in correspondence to the desired information to be transmitted, d) control means operatively connected to said energy source to adjust the output voltage level of said downhole energy source to desired level for said telemetry, e) and coupling means for coupling said switching element to the earth-drillstring system, whereby energy may be transmitted from said switching element and injected directly into the earth-drillstring system, f) said energy source comprising:

i a downhole alternator driven by the flow of mud in the hole, ii the output windings of said alternator divided into sections such that they may be combined in selected configurations to achieve a variety of output alternating current voltages, iii and a rectifier means to convert the alternating current voltage to a direct current voltage at the desired voltage level.

10. The apparatus of claim 1 wherein said control means for said switching element controls the time duration of the output energy.

11. The apparatus of claim 1 wherein said control means for said switching element controls the wave shape of the output energy.

12. The apparatus of claim 1 wherein said control means for said switching element controls the frequency of the output energy.

13. An apparatus for electromagnetic telemetry of information from a drillstring location in a borehole in the earth, to another location, the drill string and the earth defining an earth-drillstring system comprising:

a) a direct switching element to couple energy from a downhole source to the earth-drillstring system, b) an energy source, with internal connections, having selectively controllable output levels downhole allowing selective adaptation to different voltage levels of signal transmission, c) a means to control said switching element in correspondence to the desired information to be transmitted, d) control means operatively connected to said energy source to adjust the output voltage level of said downhole energy source to desired level for said telemetry, e) and coupling means for coupling said switching element to the earth-drillstring system, whereby energy may be transmitted from said switching element and injected directly into the earth-drillstring system, f) said control means including means to the internal connections of enable manually made changes to said energy source at the surface of the earth prior to entry of the telemetry system into the borehole.

14. An apparatus for electromagnetic telemetry of information from a drillstring location in a borehole in the earth, to another location, the drill string and the earth defining an earth-drillstring system comprising:

a) a direct switching element to coupled energy from a downhole source to the earth-drillstring system, b) an energy source, with internal connections, having selectively controllable output levels downhole allowing selective adaptation to different voltage levels of signal transmission, c) a means to control said switching element in correspondence to the desired information to be transmitted, d) control means operatively connected to said energy source to adjust the output voltage level of said downhole energy source to desired level for said telemetry, e) and coupling means for coupling said switching element to the earth-drillstring system, whereby energy may be transmitted form said switching element and injected directly into the earth-drillstring system, f) said control means including means to the internal connections of enable automatic changes to said energy source in response to measured values of the power level being transmitted into the earth-drillstring system.

15. The apparatus of claim 1 including acoustic means at the surface connected in command transmitting relation with said control means.

16. The apparatus of claim 1 including electromagnetic means connected in command transmitting relation with said control means.

17. The apparatus of claim 1 including a mud pump connected in command transmitting relation with said control means such that said commands are transmitted from the surface by means of variation in the pressure of a mud stream pumped from the surface to the downhole location.

18. An apparatus for electromagnetic telemetry of information from a drillstring location in a borehole in the earth, to another location, the drill string and the earth defining an earth-drillstring system comprising:

a) a direct switching element to couple energy from a downhole source to the earth-drillstring system, b) an energy source having selectively controllable output levels downhole allowing selective adaptation to different voltage levels of signal transmission, c) a means to control said switching element in correspondence to the desired information to be transmitted, d) control means operatively connected to said energy source to adjust the output voltage level of said downhole energy source to desired level for said telemetry, e) and coupling means for coupling said switching element to the earth-drillstring system, whereby energy may be transmitted from said switching element and injected directly into the earth-drillstring system, f) said control means being sensitive to changes in earth-drillstring load impedance and includes means to control said downhole energy source to increase output voltage level thereof in response to increase in said level impedance.

19. The combination of claim 1 whereby said coupling means includes spaced electrodes one of which is operatively connected to a first portion of the drill string to transmit signals via the string to the earth's surface, and the other of which contacts a portion of the string electrically isolated from said first portion, to transmit signals via the earth to the earth surface, and including circuit means to detect said signals at the string and at the earth's surface and to preview said detected signals.

20. In apparatus for telemetry data from a first sub-surface location in a well to another location vertically offset from said first location, the combination comprising:

a) means associated with a drillstring in a well, to generate carrier voltage at selected level, b) means for switching said selected level voltage between ON and OFF states, as a function of a modulation pattern corresponding to data to be transmitted from said first sub-surface location in the well to said other location, c) and means to apply said switched selected level voltage to the drillstring, for transmission to said other location, d) said voltage level controlled as a function of impedance encountered during said transmission.

21. The combination of claim 20 wherein said means to apply said switched selected voltage level voltage to the drillstring includes terminals to apply voltage to vertically offset points on the drillstring, and including means electrically insulating said points, one from another.

22. The combination of claim 21 including circuitry at said other location, to receive said signals transmitted i) upwardly via the drillstring, ii) and upwardly via the earth, for subsequent processing.

23. In apparatus for telemetering information from a downhole location in a borehole and via a pipestring, upwardly in the borehole, the combination comprising:

a) an electrical energy source having controllable output level, downhole, b) means coupled to said energy source to control said output level thereof, c) switching means operatively connected to said energy source to control application of power from said source to said pipestring in a sequence of higher and lower power levels, d) and means coupled to said switching means to control operation thereof as a function of data to be transmitted from downhole upwardly toward the earth's surface, e) the control of said output level operating to aid said upward transmission of data as aforesaid.

24. In the method of telemetering information from a downhole location in a borehole and via a pipestring in the borehole, the steps including a) applying electrical energy to the pipestring for transmission upwardly, from a downhole locus, b) modulating said application of energy to the pipestring as a function of data to be telemetered upwardly, c) and controlling the amplitude of said energy application as a function of input impedance characteristic of the pipestring as effectively sensed at the locus of said energy application to the pipestring, thereby to facilitate said telemetering.

25. The method of claim 24 wherein said step b) modulation includes switching said energy application between upper and lower voltage levels.

26. The method of claim 25 wherein said amplitude controlling step includes controlling said upper level as a function of said input impedance.

27. The method of claim 26 wherein said amplitude controlling step includes providing a predetermined voltage level $V_1$, comparing said level $V_1$ with a voltage level $V_2$ at said locus to produce a signal S, and using said signal S to control said energy application amplitude.

28. The method of claim 24 including providing an electrical energy source at said downhole location, and using said source to carry out said energy applying step.

29. The method of claim 28 wherein said providing of said source includes providing multiple voltage sources, and said amplitude controlling step includes variably connecting said voltage sources to produce an output voltage characteristic of said energy application to the pipestring.

* * * * *

UNITED STATES PATENT AND TRADEMARK OFFICE

CERTIFICATE OF CORRECTION

PATENT NO. : 5,130,706

DATED : July 14, 1992

INVENTOR(S) : Donald H. Van Steenwyk

It is certified that error appears in the above-identified patent and that said Letters Patent is hereby corrected as shown below:

Column 5, line 14; "of the coil at is interior region. This filed then provides" should read --of the coil at its interior region. This field then provides--

Column 5, line 68; "twelve cells in series (see 4a-5). These combinations" should read --twelve cells in series (see 4a-6). These combinations--

Column 6, line 27; "source of alternating current. The magnetic course 61" should read --source of alternating current. The magnetic core 61--

Column 6, line 68; "lead successively engaging circularly spaced controls to" should read --lead successively engaging circularly spaced contacts to--

Column 8, line 5; "4, 3, 2 and 2. For only four cells they are 4, 2 and 1. If" should read --4, 3, 2 and 1. For only four cells they are 4, 2 and 1. If--

Column 10, (Claim 13) lines 65 and 66, "f) said control means including means to the internal connections of enable manually made changes to" should read --f) said control means including means to enable manually made changes to--

UNITED STATES PATENT AND TRADEMARK OFFICE

CERTIFICATE OF CORRECTION

PATENT NO. : 5,130,706

DATED : July 14, 1992

INVENTOR(S) : Donald H. Van Steenwyk

It is certified that error appears in the above-indentified patent and that said Letters Patent is hereby corrected as shown below:

Column 11, (Claim 14) lines 23 and 24, "f) said control means including means to the internal connections of enable automatic changes to said" should read --f) said control means including means to enable automatic changes to said--

Signed and Sealed this

Fourteenth Day of February, 1995

*Attest:*

*Attesting Officer*

Bruce Lehman

BRUCE LEHMAN

*Commissioner of Patents and Trademarks*